US006899509B1

(12) United States Patent
Mailleux

(10) Patent No.: US 6,899,509 B1
(45) Date of Patent: May 31, 2005

(54) METHOD AND A SYSTEM FOR ESTABLISHING MECHANICAL AND MULTIPLE-FLUID COUPLINGS BETWEEN A TOOL AND A TOOL-CARRIER FRAME

(75) Inventor: Loïc Mailleux, Rennes (FR)

(73) Assignee: Mailleux S.A., Acigne (FR)

( * ) Notice: Subject to any disclaimer, the term of this patent is extended or adjusted under 35 U.S.C. 154(b) by 0 days.

(21) Appl. No.: 10/363,895

(22) PCT Filed: Sep. 7, 2001

(86) PCT No.: PCT/FR01/02778

§ 371 (c)(1),
(2), (4) Date: Jul. 8, 2003

(87) PCT Pub. No.: WO02/20906

PCT Pub. Date: Mar. 14, 2002

(30) Foreign Application Priority Data

Sep. 8, 2000 (FR) ..... 00/11441

(51) Int. Cl.[7] ..... E02F 3/28
(52) U.S. Cl. ..... 414/723; 37/468
(58) Field of Search .... 414/723; 37/468; 172/272–275

(56) References Cited

U.S. PATENT DOCUMENTS 3,243,066 A 3/1966 Gardner et al.
5,802,753 A 9/1998 Raunisto
6,301,811 B1 * 10/2001 Gilmore, Jr. ..... 37/468

FOREIGN PATENT DOCUMENTS

| | | |
|---|---|---|
| DE | 197 51 292 C1 | 2/1999 |
| JP | 8 049253 | 2/1996 |
| WO | WO 97/30231 | 8/1997 |

* cited by examiner

*Primary Examiner*—Donald W. Underwood
(74) *Attorney, Agent, or Firm*—McCormick, Paulding & Huber LLP

(57) ABSTRACT

The invention concerns a system wherein the tool-bearing frame (1) and the tool (2) are each equipped with a multiple fluidic connection box, for example hydraulic provided with complementary male-female connecting members: each of said boxes is provided with a mobile and retractable protective cover, which normally covers the connecting members contained in said box. Said covers are arranged such that, in a first phase, the proper positioning of the tool-bearing-frame opposite the tool automatically causes the covers to retract, directly matching the fluidic connection members of the two boxes, so as to enable subsequently, in the second and third phases, the mechanical followed by the fluidic connection of the tool-bearing frame and the tool. The system protects the connecting members from the outside environment, while enabling easy and secure connection of the tool with the tool-bearing frame, without any risk of deterioration of the fluidic connectors.

11 Claims, 8 Drawing Sheets

METHOD AND A SYSTEM FOR ESTABLISHING MECHANICAL AND MULTIPLE-FLUID COUPLINGS BETWEEN A TOOL AND A TOOL-CARRIER FRAME

CROSS REFERENCE TO PRIOR APPLICATION

Applicant hereby claims foreign priority under 35 U.S.C. § 119 from PCT International Application Serial No. PCT/FR01/02778 filed 7 Sep. 2001, the disclosure of which is herein incorporated by reference.

The present invention relates both to a method and to a system for providing both mechanical and multiple-fluid couplings between the tool-carrier frame of a handling machine, such as a hydraulic loader, in particular, and an interchangeable tool.

The present invention relates both to a method and to a system for providing both mechanical and multiple-fluid coupling between the tool-carrier frame of a handling machine, such as a hydraulic loader, in particular, and an interchangeable tool.

In numerous applications, and in particular in the field of agriculture and in the field of public works, proposals have already been made for devices that are suitable for providing mechanical connection and fluid connection simultaneously between two elements, one of which constitutes a main machine, and the other of which constitutes auxiliary equipment suitable for being removably and interchangeably secured to said machine, in order to undertake some particular kind of work.

By way of example, the first element can be a self-propelled vehicle or a hoist.

The second element is any work device, for example a trailer for containing materials, or a tool suitable for performing a determined operation.

When the second element includes control members, such as actuators or fluid-driven motors (operating on hydraulic liquid and/or compressed air), it is necessary to connect various fluid feed and return ducts to ducts forming part of the first element, which ducts are in turn connected to a source delivering fluid under pressure and to a return tank where pressure is returned to atmospheric, which items are either carried directly by the first element, or are carried by another machine to which said first element is secured.

A typical situation in which such a configuration is to be encountered is that comprising an agricultural tractor having a hydraulic loader mounted thereon that is designed to receive various interchangeable tools.

The source of hydraulic pressure is located on the tractor.

The hydraulic feed ducts for the various actuators of the loader are connected to those of the tractor via a multiple connection device, for example of the kind described in document EP-B-0 390 715.

The loader includes a tool-carrier frame on which it is possible to mount and lock in position a certain number of interchangeable tools.

Some such tools also include control members such as hydraulic actuators.

Consequently, connecting the tool to the tool-carrier frame also requires a hydraulic connection to be made between the ducts feeding the actuators of the tool and hydraulic ducts present on the loader.

In the above-mentioned applications, it is advantageous to be able to proceed with couplings between the two elements that are to be connected that are simultaneous or almost simultaneous in a manner that is automatic or semiautomatic, both in terms of ensuring they are mutually locked together mechanically and in terms of providing their fluid connections and possibly also electrical connections.

Numerous devices have been proposed for this purpose; in this respect, mention can be made in non-exhaustive manner of the following documents that illustrate the state of the art in this field: GB-A-1 490 087, DE-A-61 531 835, DE-A-2 900 866, DE-U-90/13888, EP-A-0 434 472, EP-B-0 483 232, EP-A-0 602 165, FR-A-2 676 765, FR-A-2 684 120, FR-A-2 687 115, U.S. Pat. No. 4,368,899, U.S. Pat. No. 4,630,878, U.S. Pat. No. 5,108,252, WO-97/30231, and WO-99/11874.

In general, multiple-fluid connection devices are made up of two boxes that are generally in the form of rectangular parallelepipeds, each of which has an open face.

One of the two boxes is provided with a set of male fluid connection members, while the other is provided with a set of complementary female connection members.

The two sets of male and female connectors are identical in number and occupy similar positions within their respective boxes such that when the two boxes are brought into coincidence, with their openings facing each other, each of the female members is exactly in alignment with the corresponding male member.

Thus, if one of the two boxes is pushed home against the other so that together they form a closed box, each male connector is caused to engage in the corresponding female connector, thus providing the looked-for multiple fluid connections.

In general, the boxes are also provided with at least one set of likewise male/female pins for additionally providing an electrical connection.

This is necessary whenever the tool for coupling includes an electrically-controlled device.

In both of the applications mentioned above, i.e. public works and agriculture, the ambient conditions in which operations are performed are often polluted, with the air containing a large amount of dust or other undesirable particles, running the risk of accumulating in the boxes, and even inside the connector members.

Such ambient pollution can give rise to serious problems insofar as in order to obtain a suitable fluid connection, it is necessary for the male portions to be engaged in the female portions with tolerances that are very precise, with accurate alignment, and without the presence of any particles that might hinder such engagement, since otherwise the connector is likely to leak or to suffer damage.

In document DE 197 51 292, a mechanism is described for protecting fluid connection elements in which one of the sets of elements, specifically the set of male elements, is carried by a first support secured to a tool-carrier device, such as the arm of an excavator, for example, while the other set, specifically the female elements, is carried by a second support secured to a removable and interchangeable tool.

Each of the supports is in the form of a cylinder surrounded by a split cylindrical sleeve (of C-shaped section) disposed coaxially about the support. Each sleeve acts as a protective cover which is suitable for pivoting on its support so as to occupy selectively either a first position in which it covers and protects the associated set of connectors from being dirtied, or a second position in which it uncovers the connectors.

When not in use, the sleeves automatically take up said first, protective position.

When the two supports are moved towards each other for the purpose of coupling the male and female connectors together, the two sleeves are caused to turn by means of appropriate control members, thereby uncovering the connectors and allowing coupling to take place.

In contrast, that document does not give any indication about the way in which the mechanical coupling is implemented between the tool-carrier and the tool; that document is concerned only with the structure of the split sleeve members that protect the fluid connection elements, and the way in which they are caused to retract immediately prior to making a fluid connection.

It is merely stated (column 5, lines 1 to 5 in DE 197 51 292) that said fluid connection can be established either after the mechanical coupling or simultaneously therewith.

Nevertheless, in order to avoid any risk of damaging the connection members, both the mechanical members and the fluid members, and also to avoid damaging the protective covers, it is important for those operations to take place in a well-defined and particular sequence.

SUMMARY OF THE INVENTION

That is why the main object of the present invention is to propose a method and a system for simultaneous mechanical and fluid coupling of the kind mentioned above that makes it possible to obtain permanent protection for each of the connector boxes without hindering the automatic and easy nature of coupling, by implementing coupling in a manner that is automatic and that takes place in the following three successive stages:

proper positioning of the two elements that are to be connected, i.e. of the tool-carrier frame and of the interchangeable tool, thus moving each male or female fluid connection member so that it faces and is in alignment with the associated (female or male) member;

mechanically locking the two elements together; and establishing fluid connection between the two elements.

Mechanical connection requires that the two elements be properly positioned before it can take place, and fluid connection requires that the two elements be locked together before it can take place.

In contrast, if the two elements for coupling together have not been properly positioned, and a fortiori if it is not possible to couple them together mechanically, then the fluid connection cannot be made.

This avoids actuating the fluid coupling system while the male connector members are not exactly in alignment with the female members, thereby greatly reducing any risk of damage.

This safety feature is very important given the high cost of a fluid connector, associated with the need for its components to be manufactured with precision.

Another object of the invention is to propose an automatic coupling system capable of being controlled in full by the operator without any need to get down from the driving seat of the machine, and in particular of the tractor when it is a hydraulic loader of an agricultural tractor that is involved.

Another object of the invention is to enable fluid connection to be made between the various male and female connectors even if the fluid feed ducts are under pressure.

Another object of the invention is to provide for the box carried by the tool to be positioned in such a manner as to protect it from impacts and dirt.

Finally, another object of the invention is to associate the fluid connection system with a mechanical locking system that is already in widespread use and that has proved its effectiveness, making use of a hydraulic actuator carried by the tool-carrier frame acting on sliding transverse horizontal rods suitable for penetrating into receiver holes provided in the tool.

According to the invention, the various above-mentioned objects are achieved by means of the dispositions set out below.

The method of the invention is a method of providing both mechanical and fluid coupling between the tool-carrier frame of a handling machine such as, in particular, a hydraulic loader, and an interchangeable tool, said tool-carrier frame being fitted with a first box, referred to as the "frame" box, provided with a set of male or female fluid connection members, while said tool is fitted with a second box, referred to as the "tool" box, provided with a set of complementary female or male fluid connection members, the tool-carrier frame and the tool being provided with mutual hooking and locking means, each of said frame and tool boxes being provided with a respective moving and retractable protective cover which normally covers the connection members of the associated box, said covers being arranged and positioned in such a manner that positioning the tool-carrier correctly facing the tool for the purpose of coupling them mutually together automatically causes each of the covers to be retracted and ensures that the fluid connection members of the two boxes are put into correspondence.

According to the invention, operation is performed sequentially, implementing the following successive steps:

i) approaching the tool-carrier to the tool in such a manner as to cause the two protective covers to be retracted and to position the boxes in alignment with each other in such a manner that each male or female fluid connection member is accurately facing and in alignment with the corresponding female or male member;

ii) causing the tool to be locked mechanically on the tool-carrier frame; and iii) causing the set of male fluid connection members to engage in the associated set of female members so as to provide fluid connection between the tool-carrier frame and the tool.

According to one possible advantageous characteristic of the invention, the mutual approach and positioning movement between the boxes performed in stage (i), and the movement of engaging the sets of fluid connection members of stage (iii), are movements that take place in directions that are substantially orthogonal (one being transverse and the other being axial relative to the axis of the connectors).

The system constituting the subject matter of the present invention is a system of providing mechanical and fluid coupling simultaneously between the tool-carrier frame of a handling machine such as, in particular, a hydraulic loader, and an interchangeable tool, in which said tool-carrier frame is fitted with a first box, referred to the "frame" box, provided with a set of male or female fluid connection members, while said tool is fitted with a second box, referred to as the "tool" box, provided with a set of complementary female or male fluid connection members, the tool-carrier frame and the tool being provided with mutual hooking and locking means.

This system is remarkable in that, firstly, each of said frame and tool boxes is provided with a respective moving and retractable protective cover which normally covers the connection members of the associated box, said covers being arranged and positioned in such a manner that correct positioning of the tool-carrier frame facing the tool for the purpose of coupling them together mutually automatically causes each of said covers to be retracted, and enables the fluid connection members of the two boxes to be put directly into correspondence, and that, secondly, said frame box is slidably mounted in a support fixed to the tool-carrier frame, means being provided for moving it towards said tool box after the fluid connection members of the two boxes have been put into correspondence, so as to ensure their mutual engagement.

According to an important characteristic of the invention, the system includes means suitable for mechanically locking the tool to the tool-carrier prior to moving the frame box towards the tool box in order to provide fluid connection.

In a preferred embodiment, the tool is mechanically locked to the tool-carrier by means of a pair of sliding rods mounted on the tool-carrier frame in a horizontal transverse direction, and having end portions adapted to penetrate into holes provided on the tool, the rods being displaced under the control of a hydraulic actuator mounted on the tool-carrier frame.

Advantageously, the hydraulic actuator also controls displacement of the frame box in a direction perpendicular to that of the rods via a cam device.

Furthermore, according to various advantageous but non-limiting characteristics:

- the support in which the frame box can slide has abutment members suitable for preventing the tool box from moving in order to withstand the pressure exerted by the fluid at the moment when the male connection members engage in the female connection members;
- the tool is generally in the form of a bucket having the tool box fixed to the back thereof;
- the fluid connection members are hydraulic connection members which power actuators and/or hydraulic motors fitted to the tool from a source of hydraulic liquid under pressure coming from the handling machine;
- the frame and tool boxes further comprise at least one pair of complementary male/female electrical connection pins; and
- the covers are retractable by pivoting and/or by moving in translation, and are biased by a resilient system such as a set of springs to return automatically to their active positions of protecting the connection members while the tool is being decoupled from the tool-carrier frame.

BRIEF DESCRIPTION OF THE DRAWINGS

Other characteristics and advantages of the invention appear from the following description and from the accompanying drawings which show one possible embodiment.

In the drawings.

DESCRIPTION OF THE PREFERRED EMBODIMENTS

Figure 1:
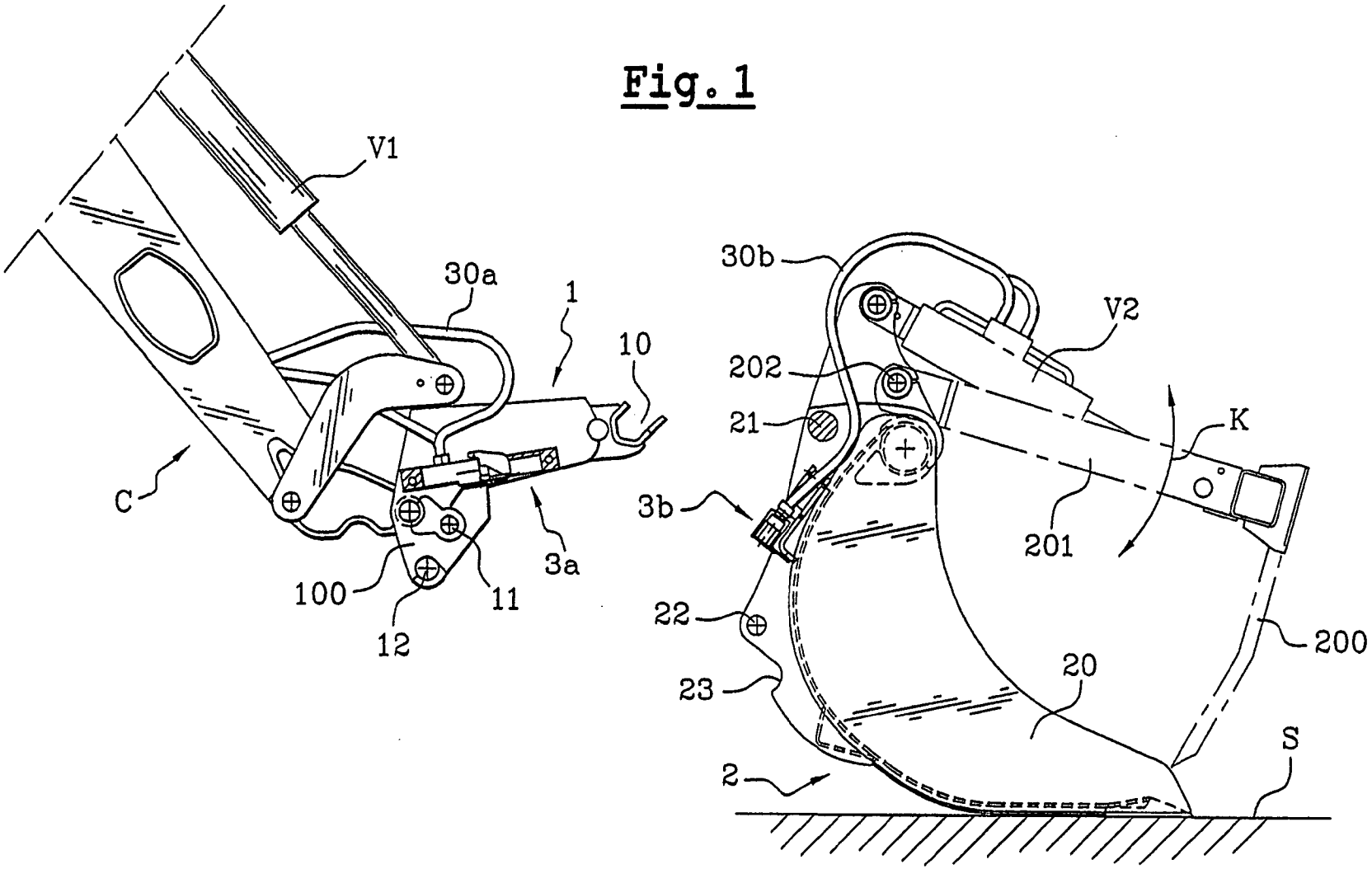
FIG. 1 is a side view of the end portion of an agricultural loader of known type and of a tool that is resting on the ground, ready to be coupled to the tool-carrier frame of the loader.
Figure 2:
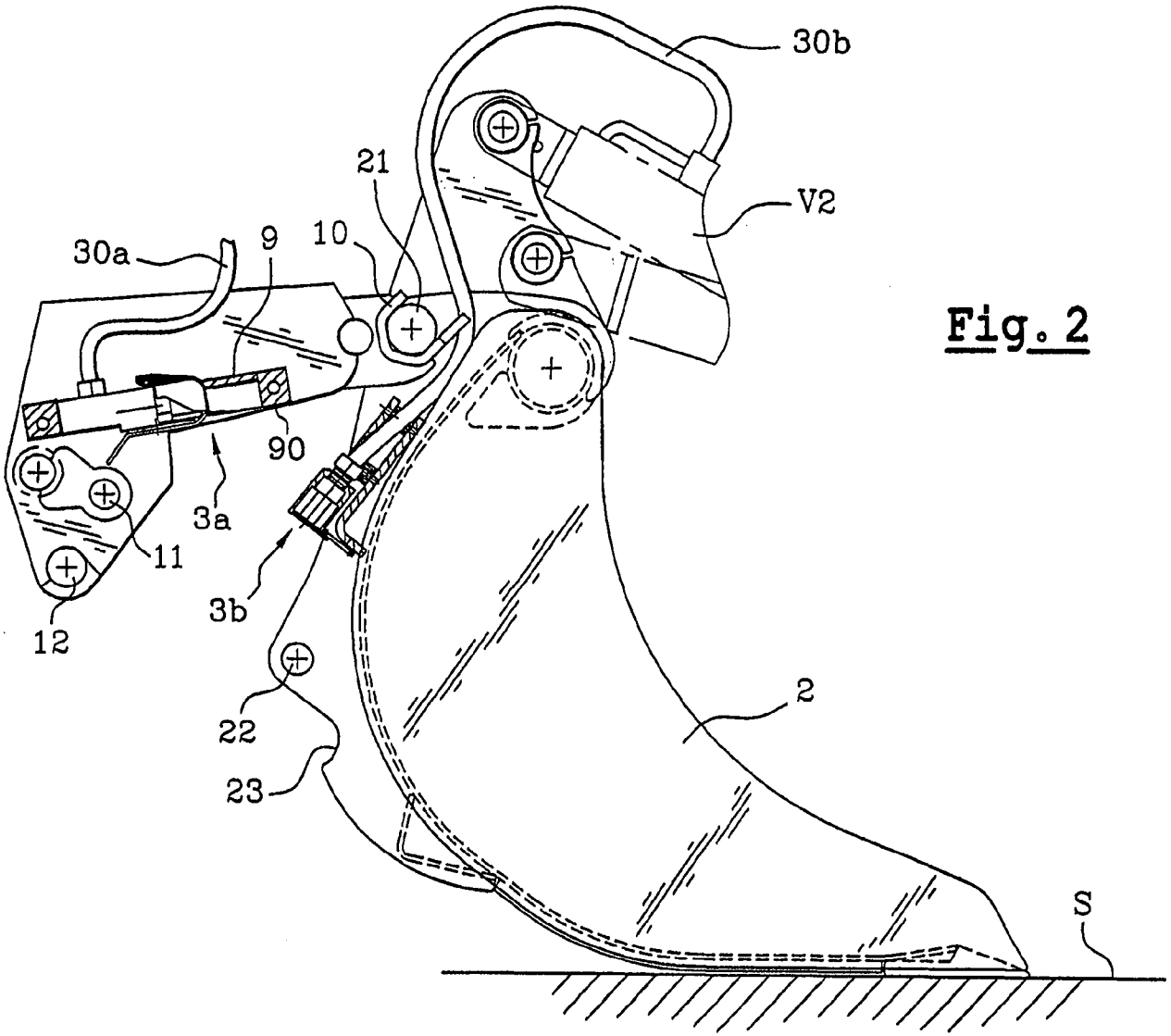
FIG. 2 is a view on a larger scale showing the approach and the beginning of hooking of the tool-carrier frame to the tool.

FIG. 1 shows the front portion of an agricultural loader of known type, mounted at the front of a tractor (not shown).

Such a loader C comprises a certain number of hydraulic actuators, including the actuator $V_1$ shown known as the "bucket actuator" which is used to pivot the tool-carrier 1 around a transverse horizontal axis, i.e. an axis perpendicular to the sheet of the drawing.

As is well known, the top end of the tool-carrier 1 presents a pair of generally U-shaped lateral hooks 10 with their open sides directed forwards and upwards.

These hooks 10 are used to hook onto the tool 2 by causing segments of bar 21 disposed near the top of the tool to engage in the hooks.

Reference 11 designates a locking rod for locking the tool-carrier to the tool, where its operation is explained below, and reference 12 designates a transverse bar for coming into abutment in notches 23 forming part of the tool. In the example shown, the tool in question is a digger bucket 20 provided with a claw 200; in conventional manner, the claw is generally configured as a rake provided with a series if teeth carried by a support 201 capable of pivoting in either direction about a shaft 202. This pivoting is symbolized in FIG. 1 by double-headed arrow K.

It is controlled by a double-acting hydraulic actuator $V_2$.

More precisely, a pair of actuators $V_2$ is provided (only one of which can be seen in the drawing) the actuators being disposed symmetrically on either side of the vertical middle axis of symmetry of the tool.

This kind of multipurpose tool is in widespread use in agriculture, in particular for stacking and unstacking operations, with the claw enabling the bucket to be filled with materials such as straw or hay, and to hold them in the bucket while they are being transported.

The tool-carrier 1 and the tool 2 are each provided with a respective half of a fluid connection assembly for the purpose of establishing a hydraulic connection between liquid feed and return ducts 30*a* of the loader and receiver ducts 30*b* feeding the pair of actuators $V_2$.

These half-assemblies referenced 3*a* and 3*b* are each constituted by a respective flat box in the form of a rectangular parallelepiped of thickness that is relatively small in the longitudinal direction.

The box 3*a* carried by the tool-carrier is mounted and guided in translation in the longitudinal direction in a support 9 which is generally in the form of a frame.

This box is fixed to the central portion at the front of the tool-carrier 1.

The box 3*b* is fixed via a support plate 4 to the outside face of the tool, i.e. to the back of the bucket 2, in the top region thereof. It is therefore not exposed to the matter contained in the bucket.

The box 3*a* is upwardly open while the box 3*b* is downwardly open.

In the example shown, the fluid connectors are hydraulic connectors having male members 60*a* carried by the box 3*a* and female members 60*b* carried by the box 3*b*.

In the example shown, four hydraulic connections 60*a*–60*b* are provided in pairs, each pair serving to provide go-and-return passages to one of the two actuators $V_2$ of the tool.

Figure 5:
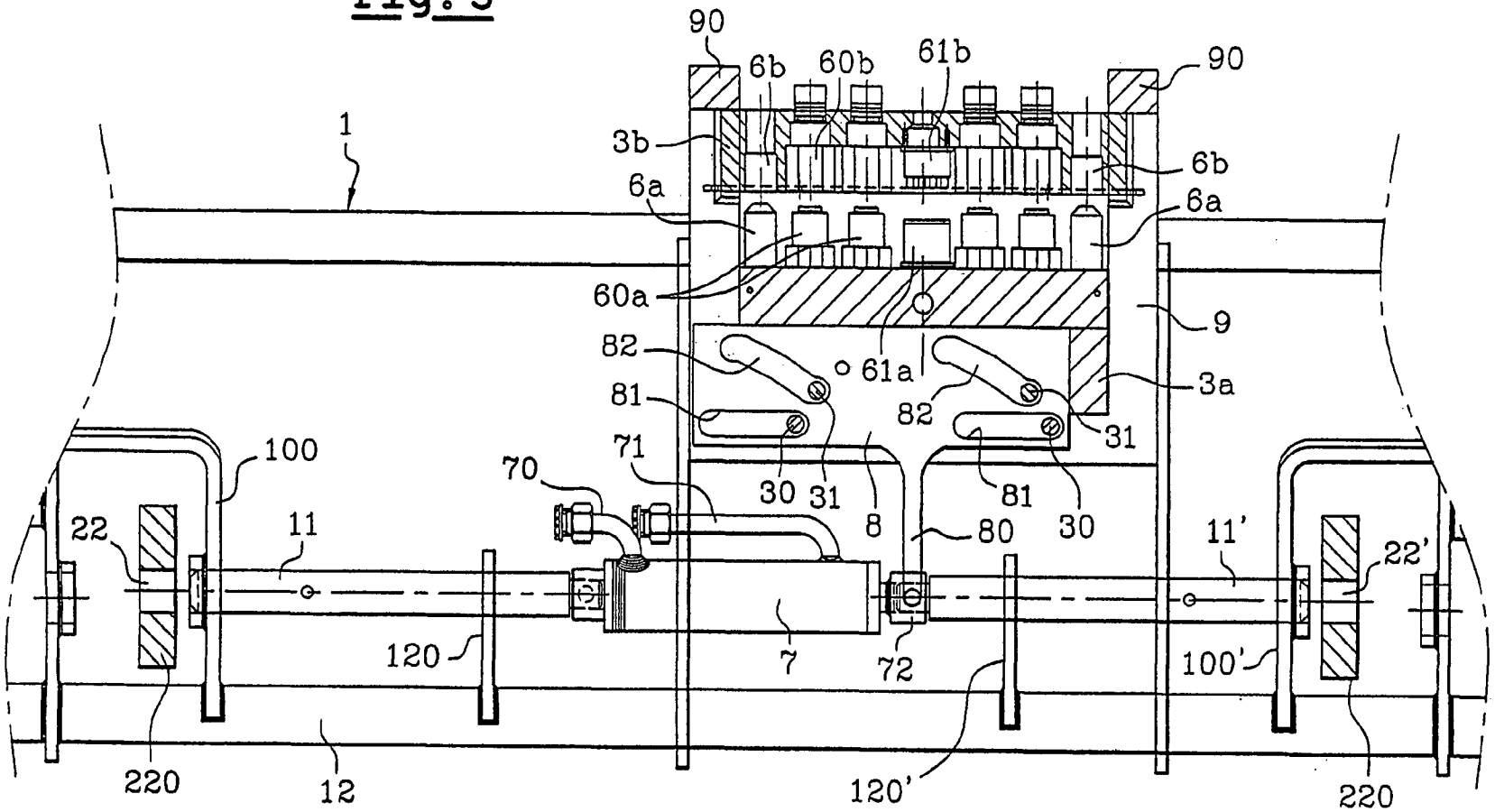
FIGS. 5 and 6 are end views of the coupling system for showing the principle of combined mechanical and fluid coupling respectively before and after coupling has taken place.

As can be seen in FIG. 5, the box 3*a* also has a pair of rods or centering pins 6*a* which are designed to engage with a small amount of clearance in receiver openings 6*b* provided in the box 3*b*.

It should also be observed that electrical connection pins 61*a* and 61*b* are also present for additionally providing an electrical connection between the loader and the tool.

This is particularly useful when the tool is fitted with solenoid valves for controlling power supply to an accessory, for example a delivery screw or an unstacking rotor (a rotary cylinder having peripheral tear-out spikes).

The axes of the pins 6, the hydraulic connectors 60, and the electrical pins 61 are all parallel, specifically being situated in a common longitudinal vertical plane parallel to the travel direction of the moving box 3*a* in its support 9.

These various elements are disposed transversely, in line.

It should be observed that a disposition of this kind is well known in itself (see for example document FR-A-1 479 487).

Figure 4A:
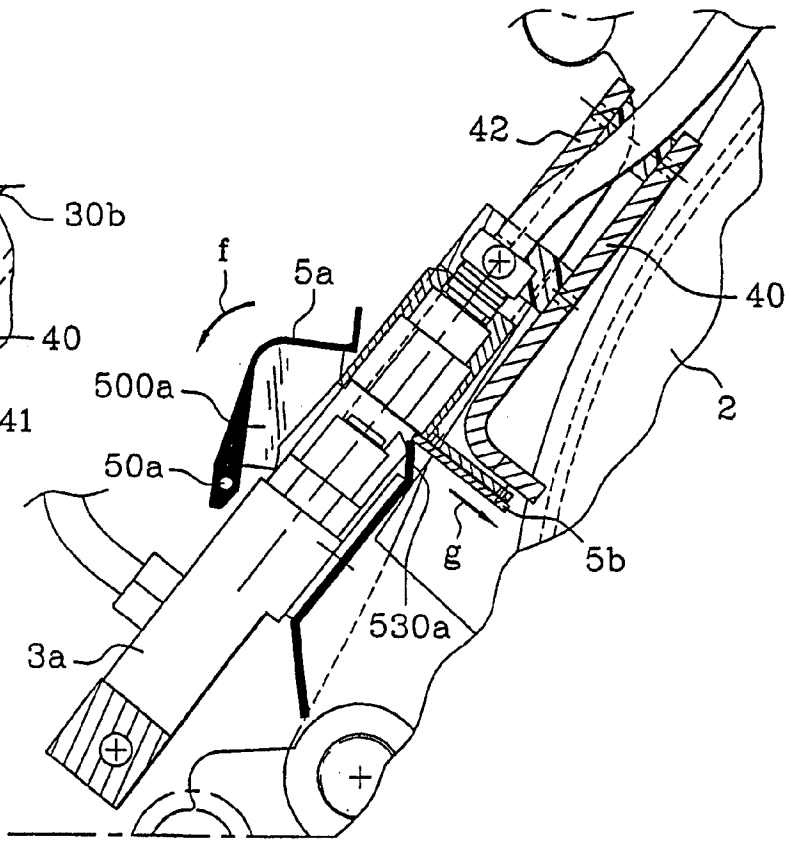
FIGS. 4 and 4A apply to positions similar to those of FIGS. 3 and 3A respectively, and show details for illustrating the corresponding positioning of the two boxes.
Figure 4:
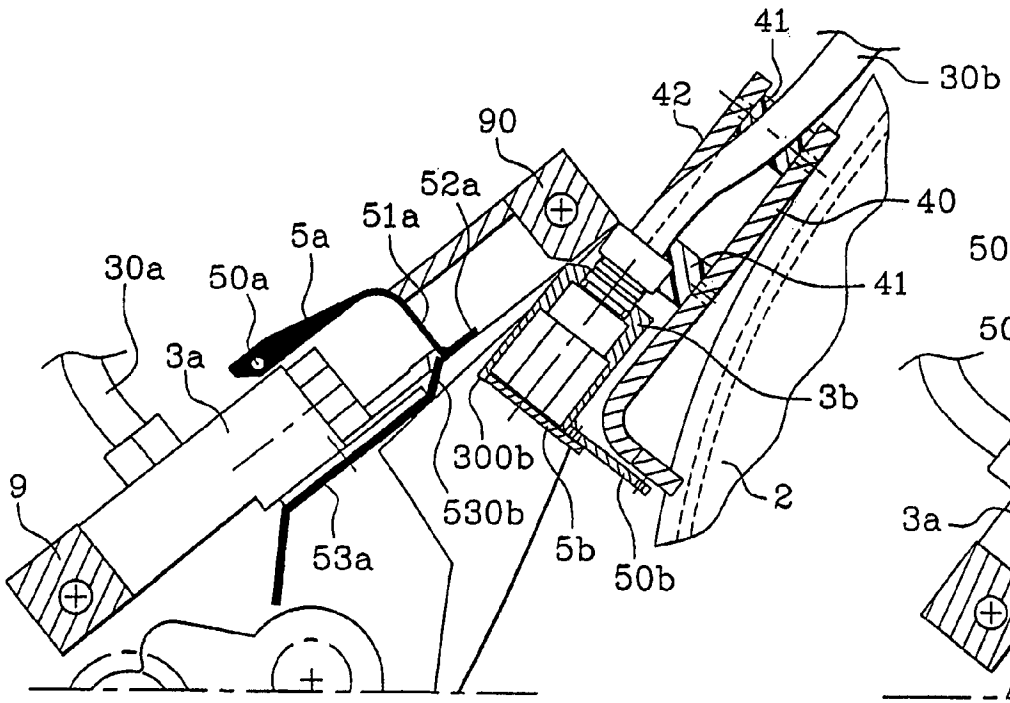

As can be seen in particular in FIGS. 4 and 4A, the box 3*a* has its top portion covered by a two-part shell. The shell comprises an angle plate 53*a* fixed to the front (tool side) of the support 9, and, towards its rear end, a hinged cover 5*a* whose transverse hinge axis 50*a* is carried by the support 9.

This shell covers the normally-open upwardly-directed space of the box above the hydraulic and electrical connection elements 60*a* and 61*a*; it naturally also covers the centering pins 6*a*.

The cover 5*a* has a section that is generally in the form of an upside-down L-shape having one limb 51*a* extending parallel over the opening of the box 3*a*. Its other limb is hinged to the rear of the box about said axis 50*a*.

Figure 7:
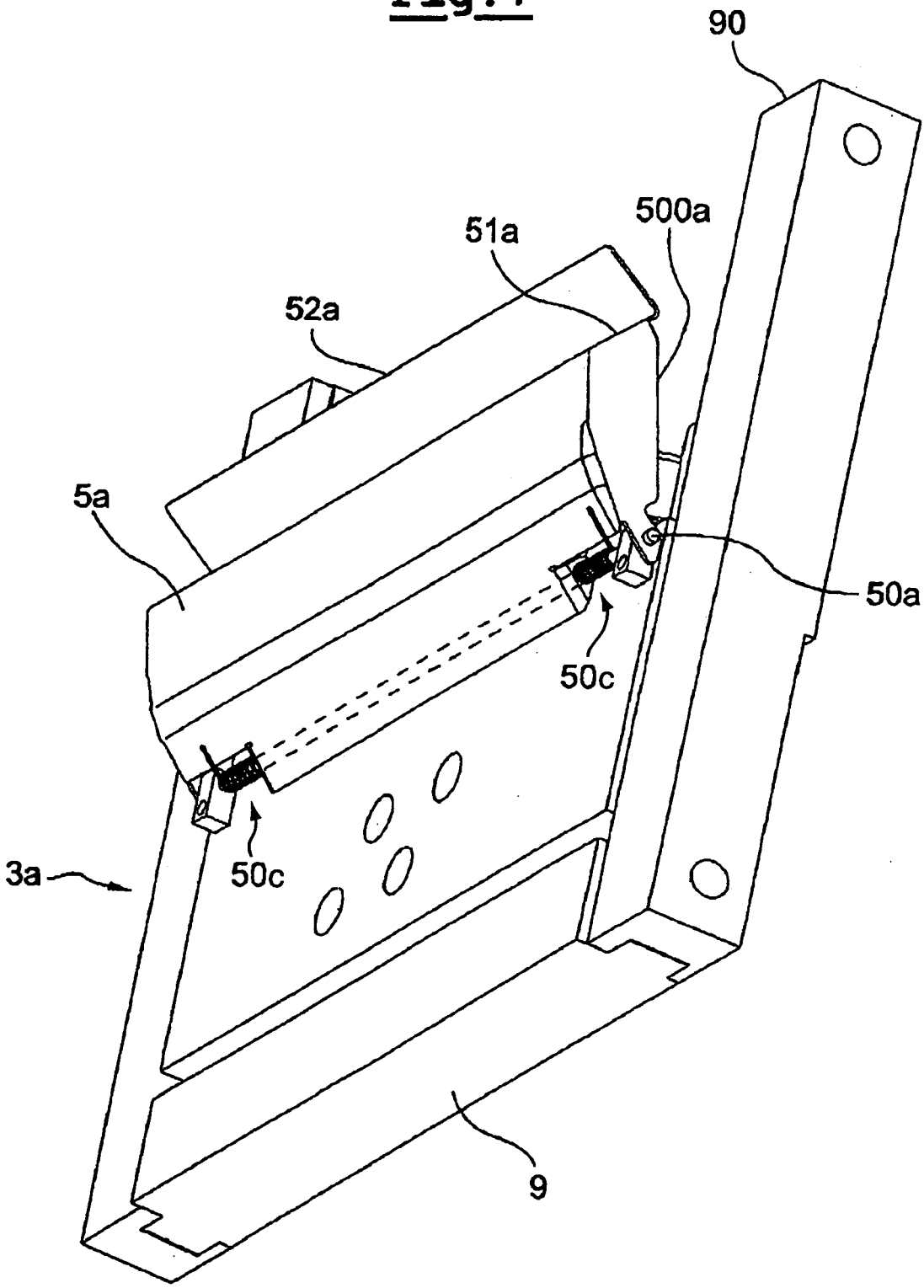
FIGS. 7 and 8 are perspective views of the retractable covers showing the resilient system for biasing the covers.

A resilient return system such as a pair of helical torsion springs 50*c*, for example (see FIG. 7), serves to hold the cover 5*a* normally in its closed position as shown in FIG. 4.

Its front end comes to bear against a sloping rim 530*a* of the fixed element 53*a*.

Together these items form a shell which completely closes the opening of the box 3*a*, since the ends of the moving cover 5*a* are provided with lateral cheeks (reference 500*a* in FIG. 4A) that protect the sides of the connectors.

The box 3*b* is provided with a cover 5*b* which constitutes a plane plate of the "guillotine" type capable of sliding forwards in its own plane.

Figure 8:
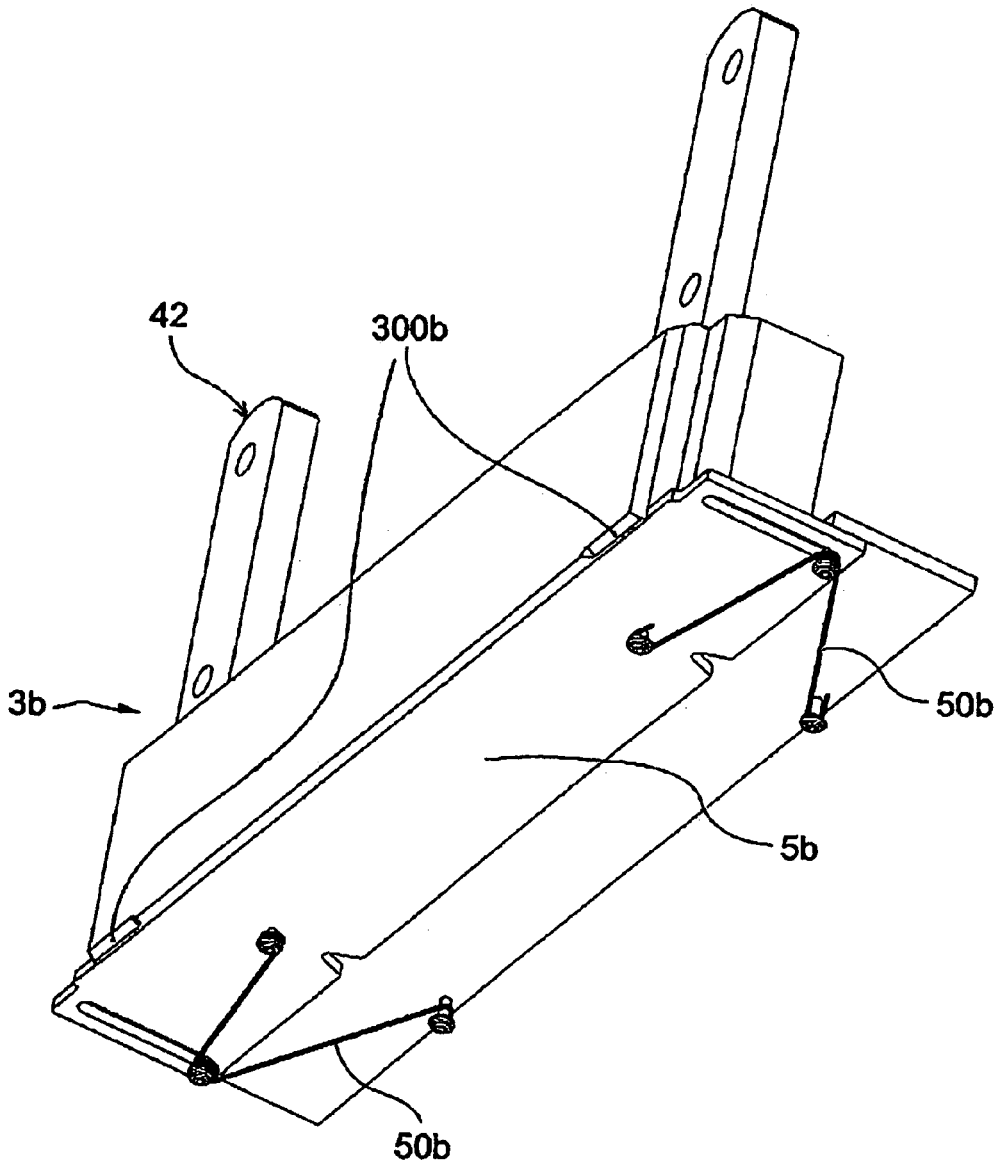

Its rear edge normally bears against a rear overhang 300*b* of the box 3*b*, and a resilient return system 50*b* (such as a set of hairpin springs, see FIG. 8) constantly urges the plate 5*b* rearwards against said overhang 300*b* into its active position where it closes the box 3*b*.

At its front end (turned towards the tool), the portion 51*a* of the cover presents a rim folded upwards at a right angle, referenced 52*a*.

As can be seen in particular in FIG. 4, it should be observed that the box 3*b* is not mounted directly on the support plate 40 fixed to the tool 2.

This box is carried by a plate 42 parallel to the support plate 40 and fixed thereto by means of silent blocks (resilient pads) that give the box 3*b* a certain amount of freedom to move relative to the tool 2.

Reference is made to FIGS. 3, 3A, 4, and 4A for explaining how the tool is hooked and positioned by the tool-carrier prior to coupling proper.

With the tool placed on the ground S, as shown in FIG. 1, the person in charge of the operation, on board the tractor, begins by acting on the appropriate actuators fitted to the loader so as to move the tool-carrier 1 towards the tool in such a manner as to position the hooks 10 beneath the bar portions 21.

Figure 3A:
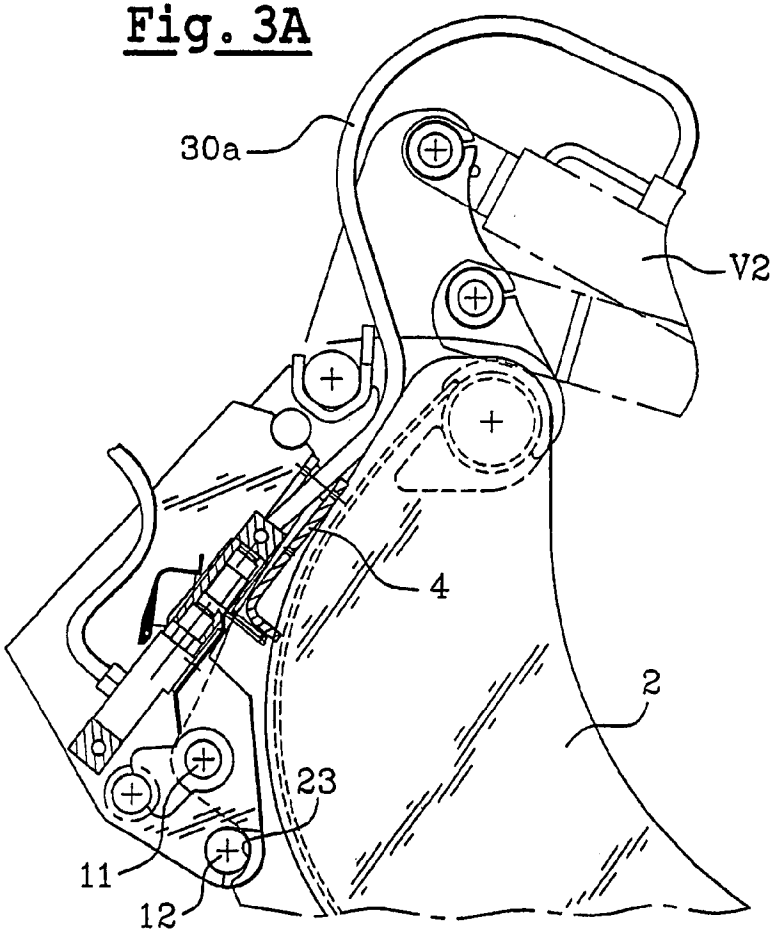
FIGS. 3 and 3A are fragmentary views on a still larger scale showing two steps in this hooking and of the subsequent positioning of the tool-carrier frame against the tool.
Figure 3:
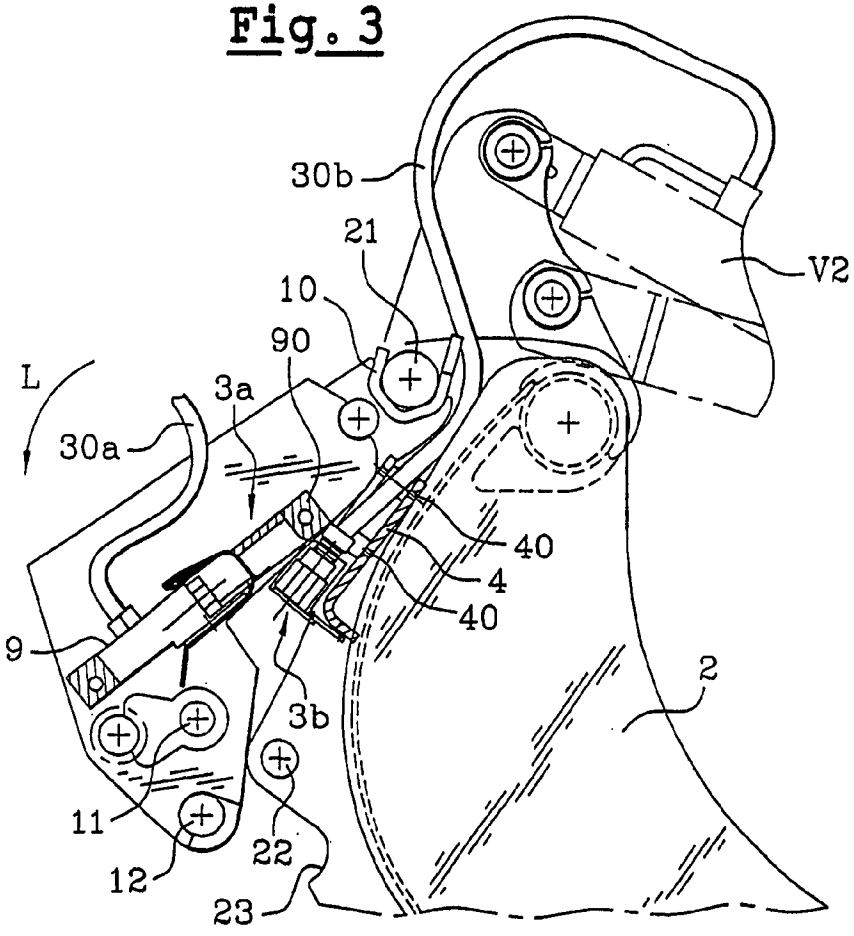

Thereafter the front portion of the loader is raised so as to lift the tool, while simultaneously using the bucket actuator $V_1$ to cause the tool-carrier to pivot in the direction represented by arrow L in FIG. 3. As a result, the abutment element 12 is received in and bears against the notch 23.

Simultaneously, the box 3*a* takes up position beneath the box 3*b*, exactly in alignment therewith.

During this movement, the appendix 52*a* of the cover meets the rear face of the box 3*b*, thereby causing it to be retracted by pivoting rearwards about its axis 50*a*. This disengagement of the cover 5*a* is represented by arrow f in FIG. 4A.

Simultaneously, the plate of the cover 5*b* is moved forwards in its own plane, as symbolized by arrow g in FIG. 4A.

For this purpose, the plate 5*b* is extended laterally on both sides by tabs which face the support 9 of the box 3*a* so that it is the support which actuates the cover 5*b* in its retraction direction, pushing it forwards against the return spring 50*b*.

Means appropriate to positioning the tool relative to the tool-carrier by means of centering elements with sloping faces are also provided. They are not shown in the drawings since they are well known in themselves, and they serve to ensure that the two elements are properly positioned transversely relative to each other (i.e. perpendicularly to the plane of the drawings).

At the end of the hooking operation, the boxes 3*a* and 3*b* are thus accurately facing each other, with each male connector element, whether hydraulic or electrical, facing and being in alignment with the corresponding female element, but without any connection yet being made; this is the situation shown in FIG. 5.

It should be observed that each of the male and female fluid elements is fitted with a closure flap which prevents any untimely escape of liquid from the connector, even if the liquid is under high pressure, i.e. the liquid cannot escape until the connection has been established.

Connectors of this kind are well known and widely available in the trade.

Figure 6:
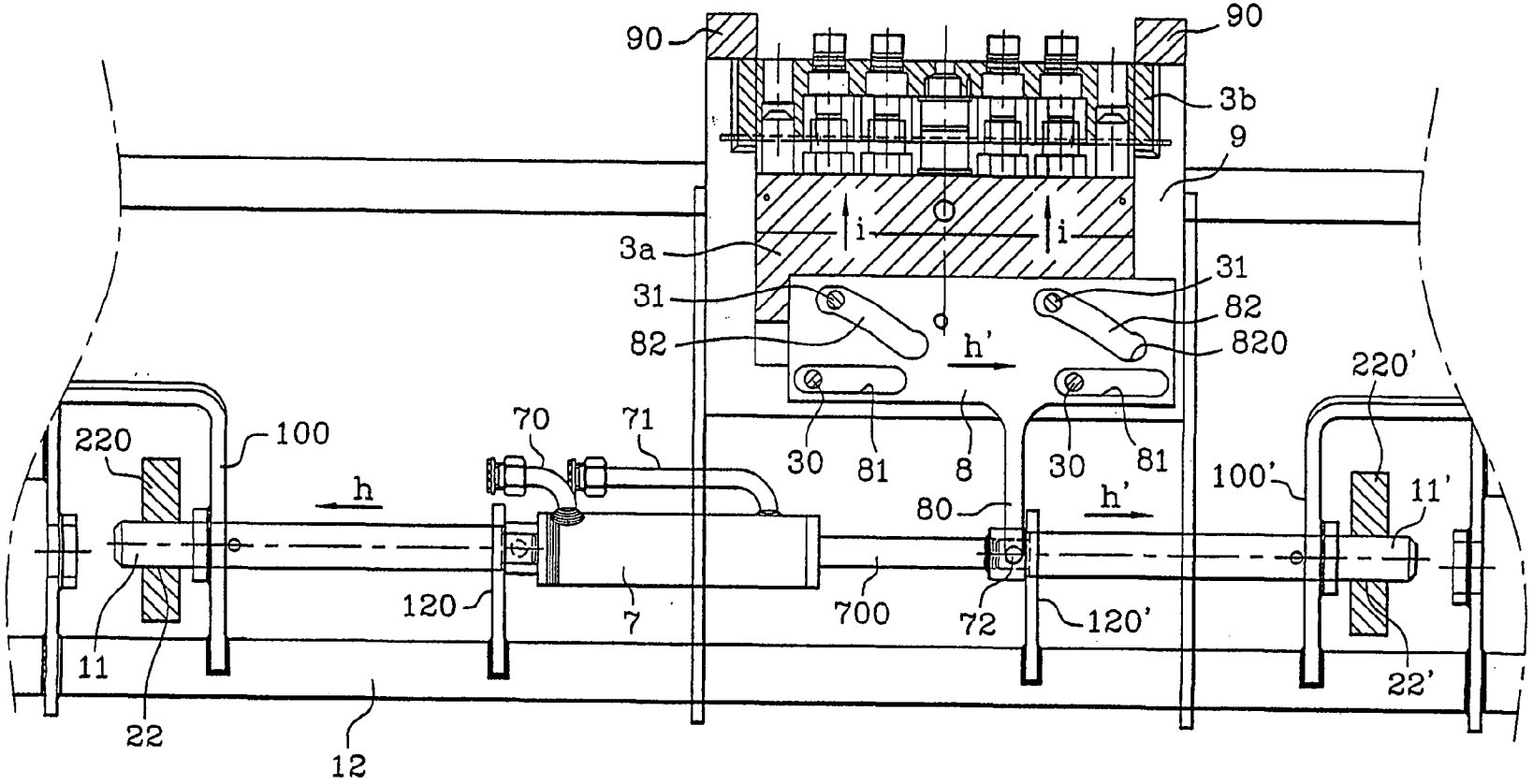

With reference to FIGS. 5 and 6, there follows an explanation of how mechanical connection is implemented and then followed by hydraulic and electrical connection between the tool and the tool-carrier.

The locking device is of conventional type and comprises a control actuator 7 secured to the tool-carrier frame, having its axis disposed horizontally and transversely.

It is a double-acting actuator, with its chambers powered via respective ducts 70 and 71 connected to the hydraulic source.

The device further comprises a pair of coaxial sliding rods 11, 11' disposed on the axis of the actuator 7, on either side thereof.

The rod 11 is secured to the actuator cylinder, while the rod 11' is secured to the actuator rod 700, which it extends.

The two rods are guided in axial translation in suitable openings formed in plates 120-100 and 120'-100' respectively which are welded to the tool-carrier frame 1.

Facing the end portion of each of the rods 11, 11' there is to be found a receiving opening 22, 22' formed in a respective piece 220, 220', secured to the tool.

The displacement of the box 3*a* in its support which takes place perpendicularly to the axis common to the actuator 7 and to the rods 11, 11', i.e. in the longitudinal direction, is under the control of a cam device 8.

This device 8 which comprises a plate is carried by the tool-carrier frame and is mounted to move thereon.

More precisely, the device 8 is mounted on the base of the support 9.

It has a pair of two elongate holes or slots 81 disposed horizontally and situated at the base of the element 8, in line with each other.

The support 9 is provided with a pair of guide fingers 30 which can slide freely, each in a respective slot 81.

Above the slots 81 there are sloping slots 82, each of which is capable of slidably receiving a finger 31 secured to the box 3*a*.

The device 8 is provided with an appendix 80 that extends downwards and that is fixed to the end of the rod of the actuator 7, in its junction zone 72 where it joins the rod 11'.

In the starting position shown in FIG. 5, the actuator 7 is retracted.

The end portions of the rods 11 and 11' are just engaged in the guide openings of the innermost plates 100 and 100'. However they are set back inwardly from the plates 220 and 220', lying outside the corresponding locking holes 22 and 22'.

Since the rod 11' is in its position corresponding to the end-of-stroke position of the actuator rod 700 towards the left (in FIG. 5), the device 8 is also in its end-of-stroke position towards the left; in this situation, the fingers 30 are at the right-hand ends of the slots 81.

As can be seen in the figure, the sloping slots 82 face downwards and towards the right, and the fingers 31 carried by the moving box 3*a* are likewise at the right-hand ends of the slots 82.

When the actuator 7 is fed with liquid under pressure via the duct 70 (with the duct 71 being connected to the supply for returning to atmospheric pressure), by operating an appropriate valve, the actuator 7 is extended.

As a result of such extension, the rod 11 is caused to move simultaneously towards the left until the left-hand portion of the actuator cylinder comes into abutment against the element 120, and simultaneously the rod 11' is caused to extend towards the right until the connection element 72 between the rod of the actuator and the rod 11 comes into abutment against the fixed part 120'.

This simultaneous extension of the two rods 11 and 11' is symbolized in FIG. 6 by respective arrows h and h'.

This displacement also acts via the appendix 80 to move the cam path 8 to the right in the direction h'.

During this displacement, the part 8 is maintained at the same height because it is guided by the fingers 30 in the slots 81. It therefore follows a path that is rectilinear and horizontal.

In contrast, the fingers 31 are constrained to follow the oblique slots 82, thereby causing the box 3*a* to slide upwards in its support 9, with this displacement being symbolized by arrows i.

It is this displacement which causes the bottom box 3*a* to be engaged in the top box 3*b*, and correspondingly which causes connection to be established between the male and female elements 60*a* and 60*b* for the hydraulic connection, and between the pins 61*a* and 61*b* for the electrical connection.

It should be observed that there is a certain offset in time between the mechanical locking which is the result of the rods 11 and 11' engaging in the holes 22 and 22', and the male connectors becoming engaged in the female connectors.

This offset is due in particular because the bottom end portions of the slots 82 are not inclined but are horizontal over a short distance (like the slots 81).

Thus, should at least one of the rods 11 fail to penetrate into the corresponding receiver hole 22 and 22' due to poor positioning of the tool relative to the tool-carrier, then the box 3*a* is not raised, or is raised insufficiently to cause the hydraulic and electrical connectors to engage mutually.

It should also be observed that inserting centering pins 6*a* in the receiver holes 6*b* makes it possible to obtain accurate alignment of the male and female connectors during connection; the risks of damage and subsequent malfunction of the connection in the two boxes are therefore limited. These risks are also small because the box 3*b* is supported by the above-mentioned silent blocks 41 which give the assembly a degree of flexibility during mutual engagement of the male members in the female members.

Finally, as can be seen in particular in FIGS. 4, 4A, 5, and 6, it is important to observe that the support 9 in which the bottom box 3*a* is guided in translation has a top portion possessing solid lateral portions 90 which serve as bearings for lateral portions of the box 3*b*, and more particularly for the top faces of said lateral portions.

These solid portions 90 thus act as abutments for the box 3*b*, and completely prevent it from moving in upward translation, so as to withstand any pressure exerted by the moving box 3*a* moving downwards during connection.

By means of this disposition, it is possible to establish a hydraulic connection between the two boxes even if some of the connectors, or all of the connectors are under hydraulic pressure.

Fluid and mechanical decoupling of the tool from the tool-carrier frame is performed in the opposite order, by powering the actuator 7 in its retraction direction, thereby initially causing the box 3*a* to move downwards away from the box 3*b* so as to disconnect the fluid and electrical elements from one another, and then mechanically unlocking the tool from the tool-carrier by disengaging the locking rods 11 and 11' from the holes 22 and 22'.

By manipulating the tool-carrier by means of the actuator $V_1$, the tool-carrier is subsequently completely disengaged from the tool.

Under the action of their return springs, the covers 5*a* and 5*b* then return automatically to their initial positions, so as to protect the connectors in each of the boxes 3*a* and 3*b*.

It should be observed that even while the tool is in use, while the two boxes are coupled together, the cover 5*a* on one side and the rim of the plate 530*a* on the other side also provide a degree of protection to the join plane between the two boxes, sheltering the assembly from surrounding pollution (see in particular FIG. 4A).

Naturally, depending on the tool which is used, each pair of fluid or electrical connectors need not necessarily be put to use. The number of connectors is selected to be sufficient to be capable of satisfying the requirements of the tool in a series of tools that requires the most connections.

What is claimed is:

1. A method of providing both mechanical and fluid couplings between a tool-carrier frame of a handling machine and an interchangeable tool, said tool-carrier frame being fitted with a frame box having a set of male or female fluid connection members, while said tool is fitted with a tool box with having a set of complementary female or male fluid connection members, the tool-carrier frame and the tool being provided with mutual hooking and locking means for removably coupling the tool to the tool-carrier frame, each of said frame and tool boxes being provided with a respective moving and retractable protective cover which normally covers the connection members of the associated box, said covers being arranged and positioned in such a manner that positioning the tool-carrier correctly facing the tool for the purpose of coupling them mutually together automatically causes each of the covers to be retracted and ensures that the fluid connection members of the two boxes are put into correspondence, said method comprising the successive step of:

i) moving the tool-carrier towards the tool in such a manner as to cause the two protective covers to be retracted and to position the boxes in alignment with each other in such a manner that each male or female fluid connection member is accurately facing and in alignment with the corresponding female or male member;

ii) causing the tool to be locked mechanically on the tool-carrier frame; and iii) causing the set of male fluid connection members to engage associated set of female members so as to provide fluid connection between the tool-carrier frame and the tool.

2. A method according to claim 1, wherein the mutual approach and positioning movement of the boxes in step i) and the engagement movement of the sets of fluid connection members in step iii) are movements that take place along directions that are substantially orthogonal.

3. A system of providing mechanical and fluid couplings simultaneously between a tool-carrier frame of a handling machine and an interchangeable tool, comprising: a frame box attached to said tool-carrier frame and having a set of male or female fluid connection members; and a tool box attached to said tool and having a set of complementary female or male fluid connection members, wherein:

the tool-carrier frame and the tool are provided with mutual hooking and locking means for removably coupling the tool to the tool-carrier frame;

each of said frame and tool boxes is provided with a respective moving and retractable protective cover which normally covers the connection members of the associated box, said covers being arranged and positioned in such a manner that correct positioning of the tool-carrier frame facing the tool for the purpose of coupling them together mutually automatically causes each of said covers to be retracted through respective interaction of the covers with each other and/or the tool-carrier frame and tool, and enables the fluid connection members of the two boxes to be put directly into correspondence; and said frame box is slidably mounted in a support fixed to the tool-carrier frame, and said system further comprises frame box displacement means attached to the tool-carrier frame for moving the frame box towards said tool box after the fluid connection members of the two boxes have been put into correspondence, so as to ensure their mutual engagement.

4. A system according to claim 3 wherein the locking means are configured to mechanically lock the tool to the tool-carrier prior to the frame box being fully moved by the frame box displacement means towards the tool box in order to provide fluid connection.

5. A system according to claim 4 wherein the locking means comprises a pair of sliding rods mounted on the tool-carrier frame in a horizontal transverse direction, and having end portions adapted to penetrate into holes provided on the tool, said rods being displaced under the control of a hydraulic actuator mounted on the tool-carrier frame.

6. A system according to claim 5 wherein said hydraulic actuator also controls displacement of said frame box in a direction perpendicular to that of said rods via a cam device.

7. A system according to claim 3 wherein said support in which the frame box can slide has abutment members suitable for preventing the tool box from moving in order to withstand the pressure exerted by the fluid at the moment when the male connection members engage the female connection members.

8. A system according to claim 3 wherein said tool is a bucket having said tool box fixed to the back thereof.

9. A system according to claim 3 wherein the fluid connection members are hydraulic connection members which power actuators and/or hydraulic motors fitted to the tool from a source of hydraulic liquid under pressure coming from the handling machine.

10. A system according to claim 9 wherein said frame and tool boxes further comprise at least one pair of complementary male/female electrical connection pins.

11. A system according to claim 3 wherein said covers are retractable by pivoting and/or by moving in translation, and are biased by a resilient system return automatically to their active positions of protecting the connection members while the tool is being decoupled from the tool-carrier frame.

* * * * *

UNITED STATES PATENT AND TRADEMARK OFFICE

CERTIFICATE OF CORRECTION

PATENT NO. : 6,899,509 B1
DATED : May 31, 2005
INVENTOR(S) : Mailleux

It is certified that error appears in the above-identified patent and that said Letters Patent is hereby corrected as shown below:

Column 10,
Line 64, the word "with" should be omitted.

Column 11,
Line 21, after the word "engage" please insert -- the --.

Column 12,
Line 43, after the word "system" please insert -- to --.

Signed and Sealed this

Twenty-third Day of August, 2005

JON W. DUDAS
*Director of the United States Patent and Trademark Office*